US010112427B2

(12) United States Patent
Iguchi et al.

(10) Patent No.: US 10,112,427 B2
(45) Date of Patent: Oct. 30, 2018

(54) IMAGE DECOLORING DEVICE

(71) Applicants: KABUSHIKI KAISHA TOSHIBA, Tokyo (JP); TOSHIBA TEC KABUSHIKI KAISHA, Tokyo (JP)

(72) Inventors: Ken Iguchi, Shizuoka (JP); Isao Yahata, Shizuoka (JP); Takahiro Kawaguchi, Shizuoka (JP); Hiroyuki Taguchi, Shizuoka (JP); Hiroyuki Tsuchihashi, Shizuoka (JP); Hiroyuki Taki, Shizuoka (JP)

(73) Assignees: KABUSHIKI KAISHA TOSHIBA, Tokyo (JP); TOSHIBA TEC KABUSHIKI KAISHA, Tokyo (JP)

( * ) Notice: Subject to any disclaimer, the term of this patent is extended or adjusted under 35 U.S.C. 154(b) by 335 days.

(21) Appl. No.: 14/966,645

(22) Filed: Dec. 11, 2015

(65) Prior Publication Data

US 2016/0114610 A1 Apr. 28, 2016

Related U.S. Application Data

(62) Division of application No. 12/882,147, filed on Sep. 14, 2010.

(Continued)

(51) Int. Cl.

| | |
|---|---|
| ***B41M 7/00*** | (2006.01) |
| ***B41J 2/475*** | (2006.01) |
| ***G03G 21/00*** | (2006.01) |

(52) U.S. Cl.

CPC ..... *B41M 7/0009* (2013.01); *B41J 2/4753* (2013.01); *G03G 21/00* (2013.01)

(58) Field of Classification Search

USPC ..... 432/32; 271/3.15–3.17, 262, 271/265.01–265.04, 270; 347/139, 346;

(Continued)

(56) References Cited

U.S. PATENT DOCUMENTS 5,761,583 A 6/1998 Custer
5,781,822 A * 7/1998 Nishiyama ..... G03G 21/00 399/1

(Continued)

FOREIGN PATENT DOCUMENTS

CN 101456280 6/2009
JP H05-119672 5/1993

(Continued)

OTHER PUBLICATIONS

English Translation of Office Action dated Apr. 30, 2014, filed in Chinese Patent Application No. 201210301477.4.

(Continued)

*Primary Examiner* — Nathaniel Herzfeld

(74) *Attorney, Agent, or Firm* — Patterson & Sheridan, LLP

(57) ABSTRACT

An image decoloring device operates in a power-saving mode and in a normal mode. The image decoloring device includes a decoloring processing unit which removes a color of a decolorable colorant that forms an image on a sheet by applying heat to the sheet. A sheet carrying unit conveys the sheet through the decoloring processing unit. A processor controls the sheet carrying unit. If the image decoloring device is operating in the power-saving mode, a conveyance speed of the sheet through the decoloring processing unit is a first speed. If the image decoloring carrying unit is operating in the normal mode, the conveyance speed of the sheet through the decoloring processing unit is a second speed greater than the first speed.

8 Claims, 10 Drawing Sheets

Related U.S. Application Data

(60) Provisional application No. 61/242,720, filed on Sep. 15, 2009.

(58) Field of Classification Search
USPC ..... 430/19
See application file for complete search history.

(56) References Cited

U.S. PATENT DOCUMENTS

| | | | | |
|---|---|---|---|---|
| 6,095,164 | A | 8/2000 | Saitoh et al. | |
| 7,066,463 | B2 | 6/2006 | Zembko et al. | |
| 7,328,898 | B2 | 2/2008 | Yasui et al. | |
| 7,338,042 | B2 | 3/2008 | Shimizu | |
| 2002/0041322 | A1 | 4/2002 | Miyoshi et al. | |
| 2003/0169309 | A1* | 9/2003 | Yokoyama | B41J 29/393 347/14 |
| 2004/0141038 | A1* | 7/2004 | Takagi | G03G 15/2053 347/102 |
| 2006/0094599 | A1* | 5/2006 | Kuboyama | B41M 5/305 503/201 |
| 2006/0133854 | A1 | 6/2006 | Biegelsen | |
| 2008/0192618 | A1 | 8/2008 | Nakata et al. | |
| 2008/0279578 | A1* | 11/2008 | Monde | G03G 15/2064 399/70 |
| 2009/0147040 | A1* | 6/2009 | Okada | B41J 2/17509 347/17 |
| 2009/0154970 | A1 | 6/2009 | Yoshida et al. | |
| 2009/0166961 | A1 | 7/2009 | Namikawa | |

FOREIGN PATENT DOCUMENTS

| | | |
|---|---|---|
| JP | H06-270431 | 9/1994 |
| JP | H07-181847 | 7/1995 |
| JP | H10-214005 | 8/1998 |
| JP | 2000-246999 | 9/2000 |
| JP | 2001-027868 | 1/2001 |

OTHER PUBLICATIONS

Office Action dated Nov. 2, 2014, filed in Chinese Patent Application No. 201210301477.4, with English translation.

* cited by examiner

IMAGE DECOLORING DEVICE

CROSS-REFERENCE TO RELATED APPLICATIONS

This application is a division of U.S. patent application Ser. No. 12/882,147, filed on Sep. 14, 2010, which is based upon and claims the benefit of priority from U.S. Provisional Application No. 61/242,720, filed on Sep. 15, 2009, the entire contents of each of which are incorporated herein by reference.

FIELD

Embodiments described herein relate generally to a power-saving technique applied when a color is to be removed from an image formed on a sheet with what is called a decolorable colorant.

BACKGROUND

In a known technique, a sheet on which an image is formed with what is called a decolorable colorant is heated to remove a color from the image on the sheet, thereby making the sheet reusable.

A sheet targeted for decoloring may change in its print density, thickness and others. A color can be removed satisfactorily from a thin sheet of a low print density without applying heat of a high temperature to the sheet.

Therefore, as a result of application of the same amount of heat in decoloring to sheets of various types containing various printed contents, some of the sheets may be heated excessively, causing an issue in terms of energy saving.

In a known structure, it is determined to which extent a color is removed after decoloring. The decoloring is performed again according to the extent. In this structure, however, the decoloring should be performed twice on the same sheet. Further, heat of an amount greater than necessary may be applied in the first decoloring.

DETAILED DESCRIPTION

Figure 1:
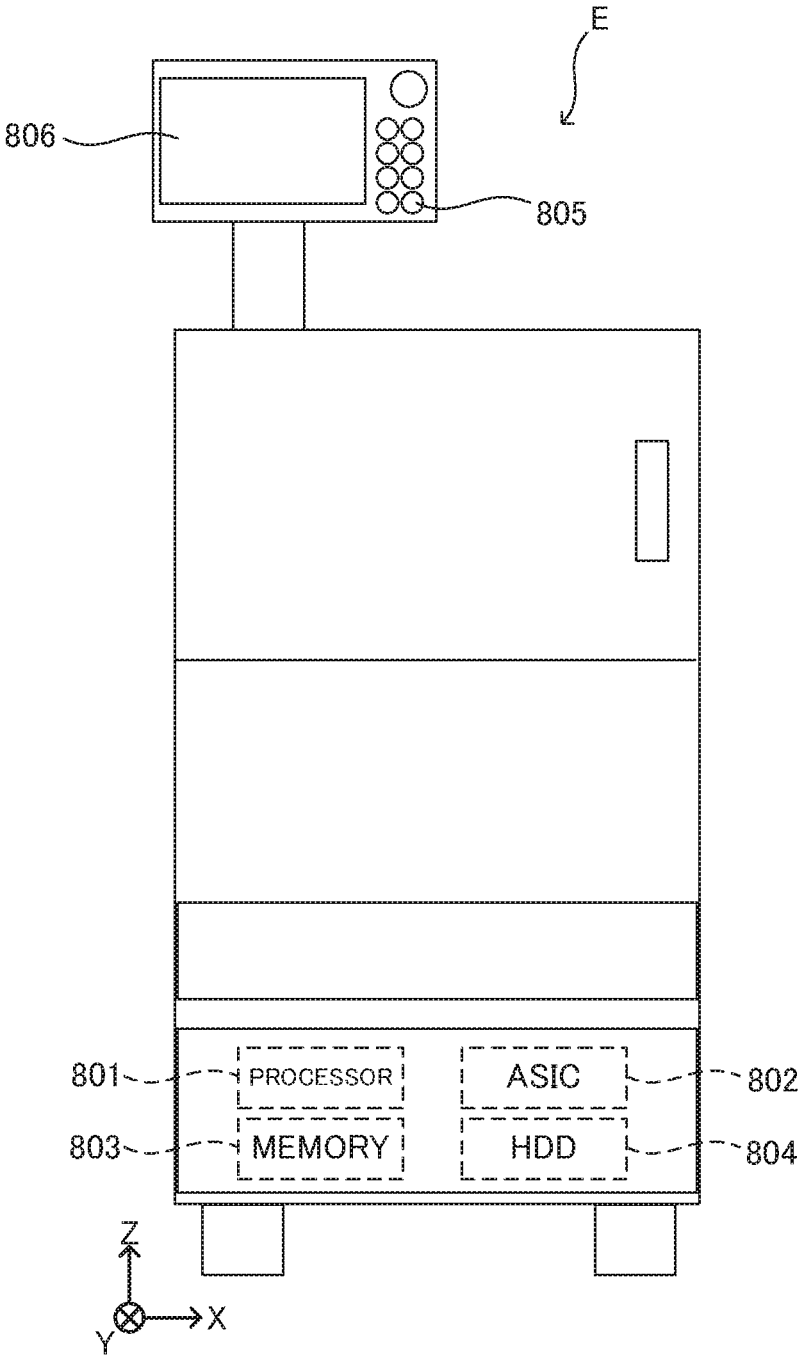
FIG. 1 shows a front view illustrating the outer appearance of an image decoloring device E of a first embodiment.

An image decoloring device of embodiments described herein generally includes a decoloring processing unit, a sheet carrying unit, a print condition detection unit, and a process controlling unit. The decoloring processing unit performs decoloring for removing the color of a decolorable colorant from a sheet on which an image is formed with the decolorable colorant. The sheet carrying unit transfers a sheet and causes the sheet to pass through the decoloring processing unit. The print condition detection unit is arranged upstream of a direction in which a sheet is transferred by the sheet carrying unit with respect to the decoloring processing unit. The print condition detection unit obtains print condition information indicating the print condition of an image formed on a sheet transferred by the sheet carrying unit. The process controlling unit controls the decoloring by the decoloring processing unit based on a result of detection given from the print condition detection unit.

An image decoloring device of embodiments described herein also includes a decoloring processing unit, a sheet carrying unit, a print condition detection unit, and a process controlling unit. The decoloring processing unit performs decoloring for removing the color of a decolorable colorant from a sheet on which an image is formed with the decolorable colorant. The sheet carrying unit transfers a sheet and causes the sheet to pass through the decoloring processing unit. The print condition detection unit is arranged upstream of a direction in which a sheet is transferred by the sheet carrying unit with respect to the decoloring processing unit. The print condition detection unit obtains print condition information indicating the print condition of an image formed on a sheet transferred by the sheet carrying unit. The process controlling unit controls a speed at which a sheet is transferred and caused to pass through the decoloring processing unit by the sheet carrying unit based on a result of detection given from the print condition detection unit.

An image decoloring device of embodiments described herein also includes a decoloring processing unit, a sheet carrying unit, a sheet thickness detection unit, and a process controlling unit. The decoloring processing unit performs decoloring for removing the color of a decolorable colorant from a sheet on which an image is formed with the decolorable colorant. The sheet carrying unit transfers a sheet and causes the sheet to pass through the decoloring processing unit. The sheet thickness detection unit is arranged upstream of a direction in which a sheet is transferred by the sheet carrying unit with respect to the decoloring processing unit. The sheet thickness detection unit determines the thickness of a sheet transferred by the sheet carrying unit. The process controlling unit controls the decoloring by the decoloring processing unit based on a result of detection given from the sheet thickness detection unit.

An image decoloring device of embodiments described herein also includes a decoloring processing unit, a sheet carrying unit, a sheet thickness detection unit, and a process controlling unit. The decoloring processing unit performs decoloring for removing the color of a decolorable colorant from a sheet on which an image is formed with the decolorable colorant. The sheet carrying unit transfers a sheet and causes the sheet to pass through the decoloring processing unit. The sheet thickness detection unit is arranged upstream of a direction in which a sheet is transferred by the sheet carrying unit with respect to the decoloring processing unit. The sheet thickness detection unit determines the thickness of a sheet transferred by the sheet carrying unit. The process controlling unit controls a speed at which a sheet is transferred and caused to pass through the decoloring processing unit by the sheet carrying unit based on a result of detection given from the sheet thickness detection unit.

An image decoloring device of embodiments described herein also includes a decoloring processing unit, a sheet carrying unit, a power consumption mode detection unit, and a process controlling unit. The decoloring processing unit performs decoloring for removing the color of a decolorable colorant by applying heat to a sheet on which an image is formed with the decolorable colorant. The sheet carrying unit transfers a sheet and causes the sheet to pass through the decoloring processing unit. The power consumption mode detection unit determines which one of a power-saving mode and a normal mode is selected. In the power-saving mode, power consumed in decoloring by the decoloring processing unit is set not to exceed a predetermined level. In the normal mode, the decoloring processing unit performs the decoloring while consuming power greater than that set in the power-saving mode. If the power consumption mode detection unit determines that the power-saving mode is selected, compared to the case where the normal mode is selected, the process controlling unit reduces a speed at which a sheet is transferred and caused to pass through the decoloring processing unit by the sheet carrying unit, while decreasing the temperature of heat applied by the decoloring processing unit to a sheet.

Embodiments are described below by referring to the drawings.

First Embodiment

A first embodiment is described first.

FIG. 1 shows a front view of the outer appearance of an image decoloring device E of the first embodiment.

The image decoloring device E performs "decoloring" for removing a color of what is called a "decolorable colorant" such as color fadable toner or color fadable ink from a sheet on which an image is formed with the colorant.

As shown in FIG. 1, the image decoloring device E of the first embodiment includes a PROCESSOR 801, an ASIC (application specific integrated circuit) 802, a MEMORY 803, a HDD (hard disk drive) 804, an operational input unit 805, and a display 806.

The operational input unit 805 is constructed of constituent elements such as a keyboard, a mouse, a touch panel, a touch pad, a graphics tablet and dedicated buttons.

The display 806 is constructed of a constituent element such as electronic paper, an LCD (liquid crystal display), EL (electro luminescence), a PDP (plasma display panel), or a CRT (cathode ray tube).

The functions of the operational input unit 805 and the display 806 may be realized by what is called a touch panel display.

In the image decoloring device E of the first embodiment, the PROCESSOR 801 is responsible for various processes to be performed in the image decoloring device E. By executing problems stored in the MEMORY 803, the HDD 804 and others, the PROCESSOR 801 also becomes operative to perform various functions. The PROCESSOR 801 may be realized by a CPU (central processing unit) or an MPU (micro processing unit) capable of performing the same calculations as those of the PROCESSOR 801. Likewise, a storage device such as a flash memory may be used instead of the HDD 804.

The MEMORY 803 is constructed of a constituent element such as a RAM (random access memory), a ROM (read only memory), a DRAM (dynamic random access memory), an SRAM (static random access memory), or a flash memory. The MEMORY 803 stores information of various types and various programs used in the image decoloring device E.

The internal structure of the image decoloring device E is described in detail below.

Figure 2:
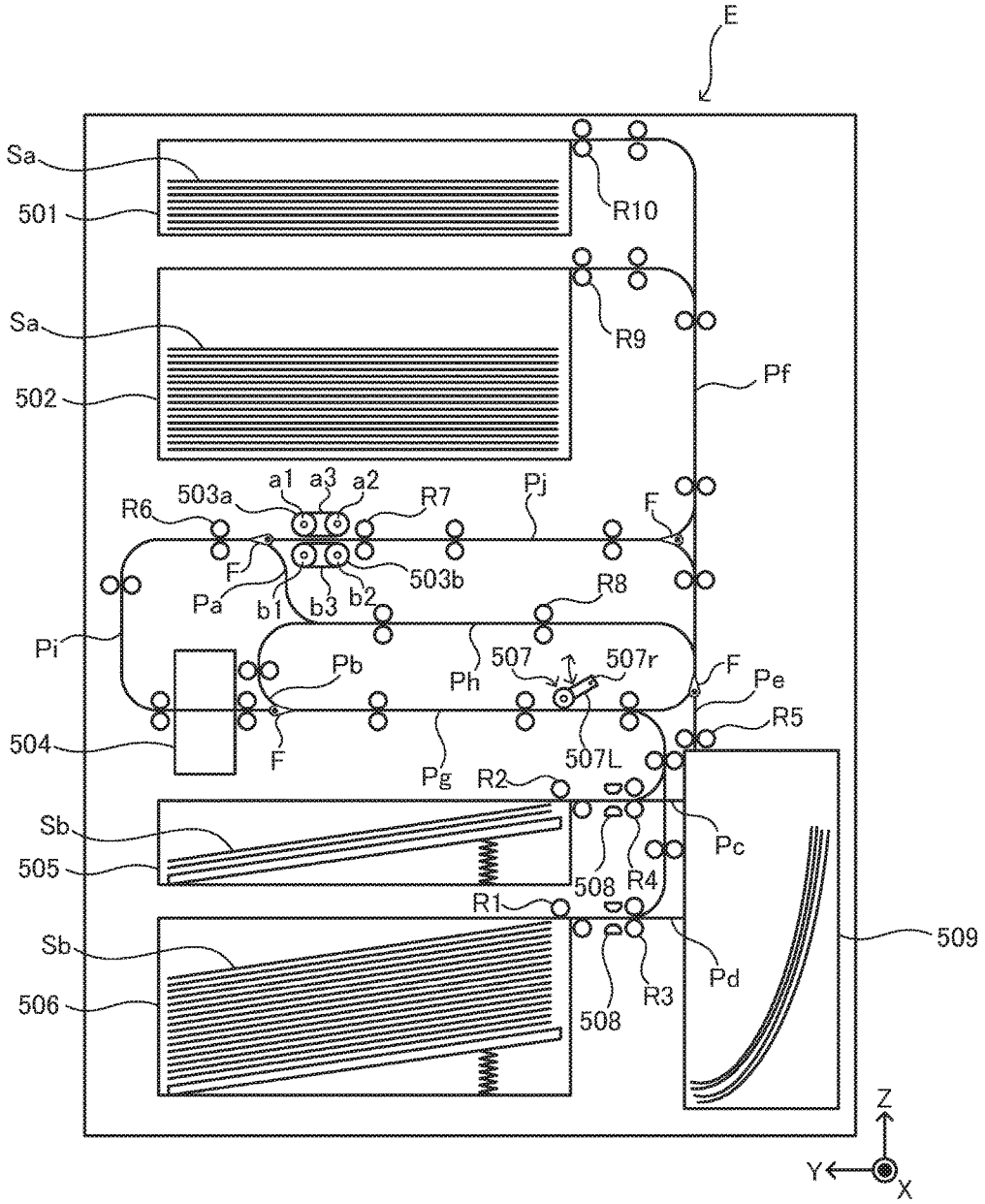
FIG. 2 shows a vertical cross-sectional view illustrating the internal structure of the image decoloring device E of the first embodiment.

FIG. 2 is a vertical cross-sectional view of the internal structure of the image decoloring device E of the first embodiment.

The image decoloring device E includes cassettes 505 and 506, ejecting cassettes 501 and 502, a reject box 509, a lever thickness sensor 507, a multi-feed sensor 508, an optical line sensor 504, decoloring processing units 503*a* and 503*b*, transfer paths including Pa to Pj, transfer rollers R3 to R8, sheet feed rollers R1 and R2, ejecting rollers R9 and R10, and flappers F. The cassettes 505 and 506 each accommodate a stack of sheets targeted for decoloring on which images are formed. The ejecting cassettes 501 and 502 each accommodate sheets after being subjected to the decoloring in the image decoloring device E. The reject box 509 (corresponding to a waste sheet storage) accommodates non-reusable sheets. The thickness sensor 507 determines the thickness of a sheet being transferred. The multi-feed sensor 508 detects multi-feed of sheets from the cassettes 505 and 506. The line sensor 504 obtains the print condition (including brightness, dirt, stain, wrinkle and color) of an image formed on a sheet being transferred. The decoloring processing units 503*a* and 503*b* apply heat to an image formed on a sheet with a decolorable colorant to remove a color therefrom. The transfer paths including Pa to Pj guide a sheet to be transferred toward a predetermined direction in which a sheet is transferred. The transfer rollers R3 to R8 transfer a sheet along the transfer paths including Pa to Pj. The sheet feed rollers R1 and R2 feed a sheet from the cassettes 505 and 506 to the transfer paths. The ejecting rollers R9 and R10 transfer a sheet after being subjected to the decoloring to the cassettes 501 and 502. The flappers F are provided at branch points of the transfer paths.

The transfer paths including Pa to Pj and the transfer rollers including R3 to R8 together correspond to the "sheet carrying unit." The PROCESSOR 801 controls drive of the transfer rollers R1 to R10. The flappers F controlled by the PROCESSOR 801 define a direction in which a sheet is transferred by the sheet carrying unit.

The sheet carrying unit includes transfer paths Pc, Pd and Pe as a "waste sheet transfer path." A sheet after passing through the line sensor 504 (print condition detection unit) in a direction in which a sheet is transferred travels along this waste sheet transfer path to the reject box 509 that accommodates non-reusable sheets.

The line sensor 504 and the PROCESSOR 801 cooperatively function as the "print condition detection unit."

The line sensor 504 is arranged upstream of a direction in which a sheet is transferred with respect to the decoloring processing units 503*a* and 503*b*. The line sensor 504 scans an image formed on a sheet transferred by the sheet carrying unit. Based on the data of an image read from a sheet by the line sensor 504, the PROCESSOR 801 obtains the print percentage, the print density, the print color (corresponding to the print condition information) and the like of the image formed on the sheet.

The line sensor 504 reads two sides of a sheet to obtain features including a print percentage, a print density and a print color as the print condition information from both sides.

The thickness sensor 507 and the PROCESSOR 801 cooperatively function as the "sheet thickness detection unit." The thickness sensor 507 is arranged upstream of a direction in which a sheet is transferred by the sheet carrying unit with respect to the decoloring processing units 503*a* and 503*b*. The thickness sensor 507 has a lever member 507L rotatable about a rotary shaft 507*r*. The lever member 507L is pressed anticlockwise in FIG. 2 about the rotary shaft 507*r* by an elastic member such as a spring. The thickness sensor 507 uses an optical sensor and the like to determine the angle of rotation of the lever member L that moves to a retracted position according to the thickness of a sheet passing through an area near the thickness sensor 507 placed in the sheet transfer path, thereby obtaining information about the thickness of the sheet.

The PROCESSOR 801 corresponds to the "process controlling unit."

The decoloring processing unit 503*a* has rollers a1 and a2, and a belt a3 stretched around these rollers. The belt a3 is caused to rotate by the rotation of these rollers. The rotation of at least one of the rollers a1 and a2 is controlled by the PROCESSOR 801. At least one of the rollers a1 and a2 is heated by a heater controlled by the PROCESSOR 801.

Likewise, the decoloring processing unit 503*b* has rollers b1 and b2, and a belt b3 stretched around these rollers. The belt b3 is caused to rotate by the rotation of these rollers. The rotation of at least one of the rollers b1 and b2 is controlled by the PROCESSOR 801. At least one of the rollers b1 and b2 is heated by a heater controlled by the PROCESSOR 801.

The decoloring processing units 503*a* and 503*b* of the aforementioned structures heat a sheet that is being held and transferred by the belts a3 and b3, the transfer rollers R6 and R7 and others, thereby removing the color of a decolorable colorant from the sheet.

Based on print condition information obtained, the PROCESSOR 801 (process controlling unit) manages control parameters for decoloring by the decoloring processing units 503*a* and 503*b*, a speed at which a sheet is transferred by the sheet carrying unit, and others.

Figure 3:
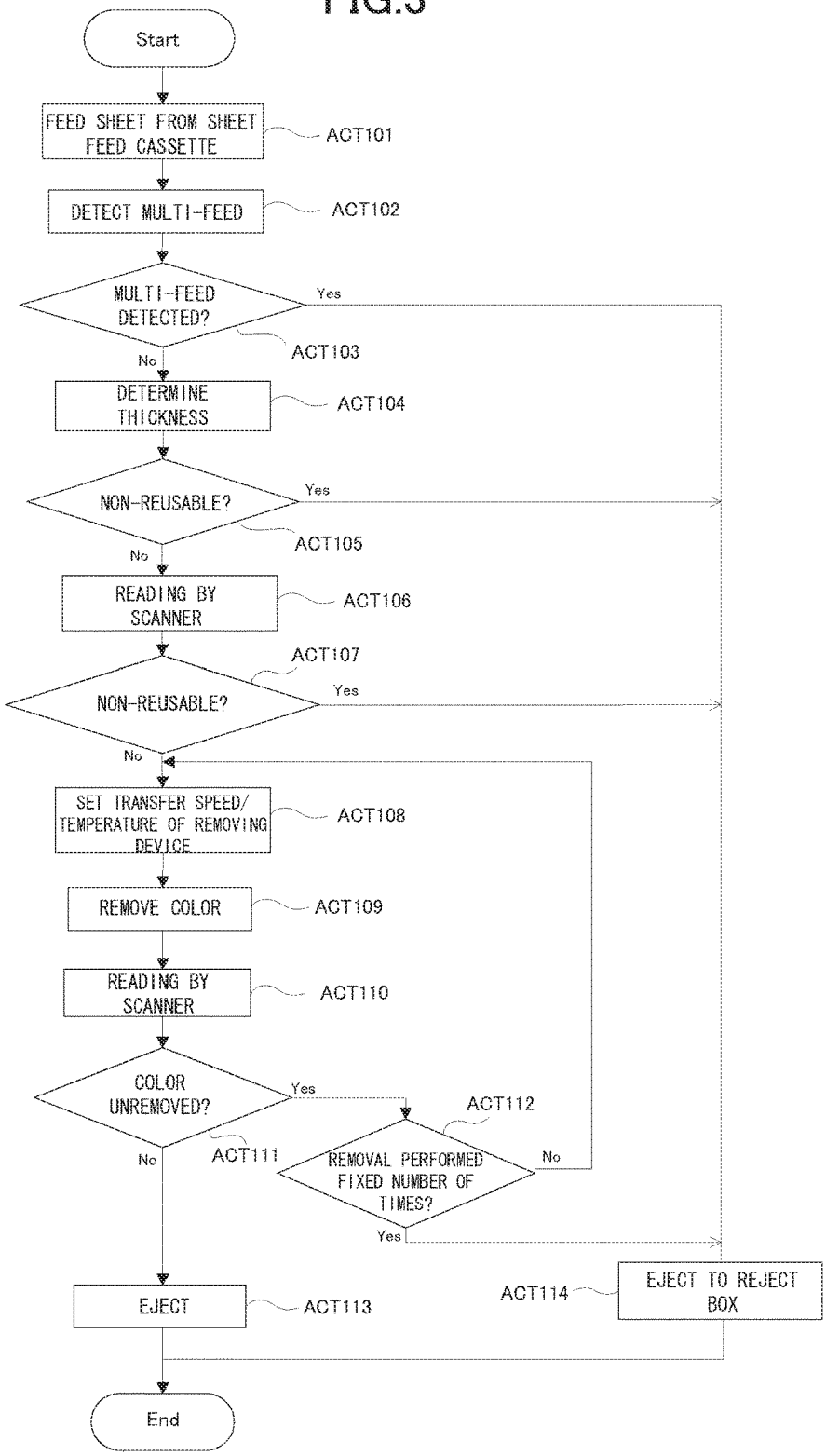
FIG. 3 is a flow chart explaining the flow of a process in the image decoloring device E of the first embodiment.

FIG. 3 is a flow chart explaining the flow of a process in the image decoloring device E. FIGS. 4 to 8 each show how a sheet is transferred in the image decoloring device E.

The PROCESSOR 801 controls the sheet feed roller R1 or R2 to feed a sheet Sb targeted for decoloring from the cassette 505 or 506 to the sheet transfer path (Act 101).

The multi-feed sensor 508 detects multi-feed of sheets from the cassettes 505 and 506 (Act 102).

Figure 4:
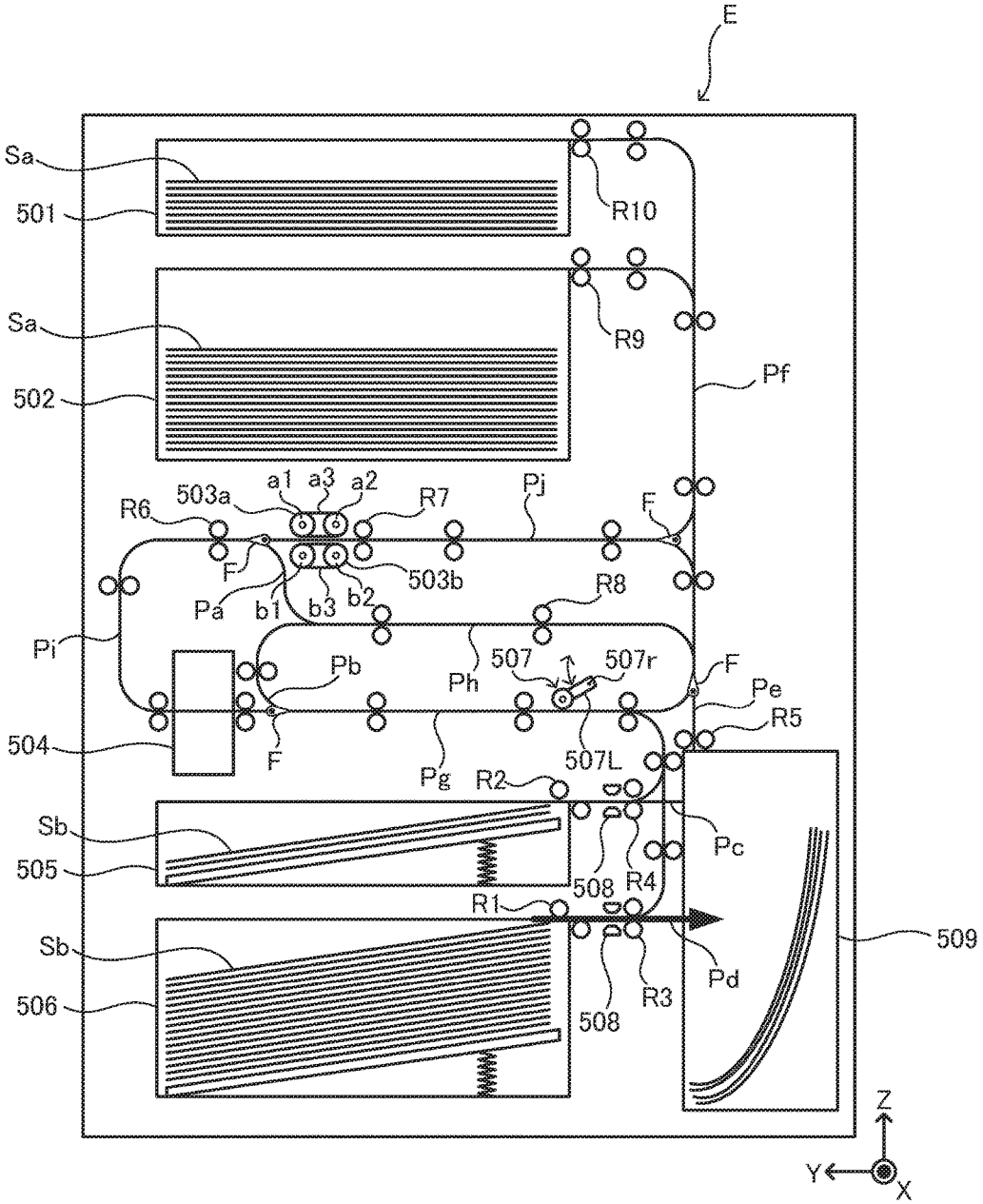
FIG. 4 is a diagram illustrating how a sheet is transferred in the image decoloring device E.

If the multi-feed sensor 508 detects multi-feed of sheets (Yes of Act 103), the PROCESSOR 801 drives the transfer roller R3 or R4 to eject the detected sheets through the transfer path Pc or Pd to the reject box 509 (Act 114) (see an arrowed thick line in FIG. 4).

Next, the PROCESSOR 801 uses the thickness sensor 507 to determine the thickness of a sheet fed solely without combination with another sheet, to obtain resultant information (Act 104).

Figure 5:
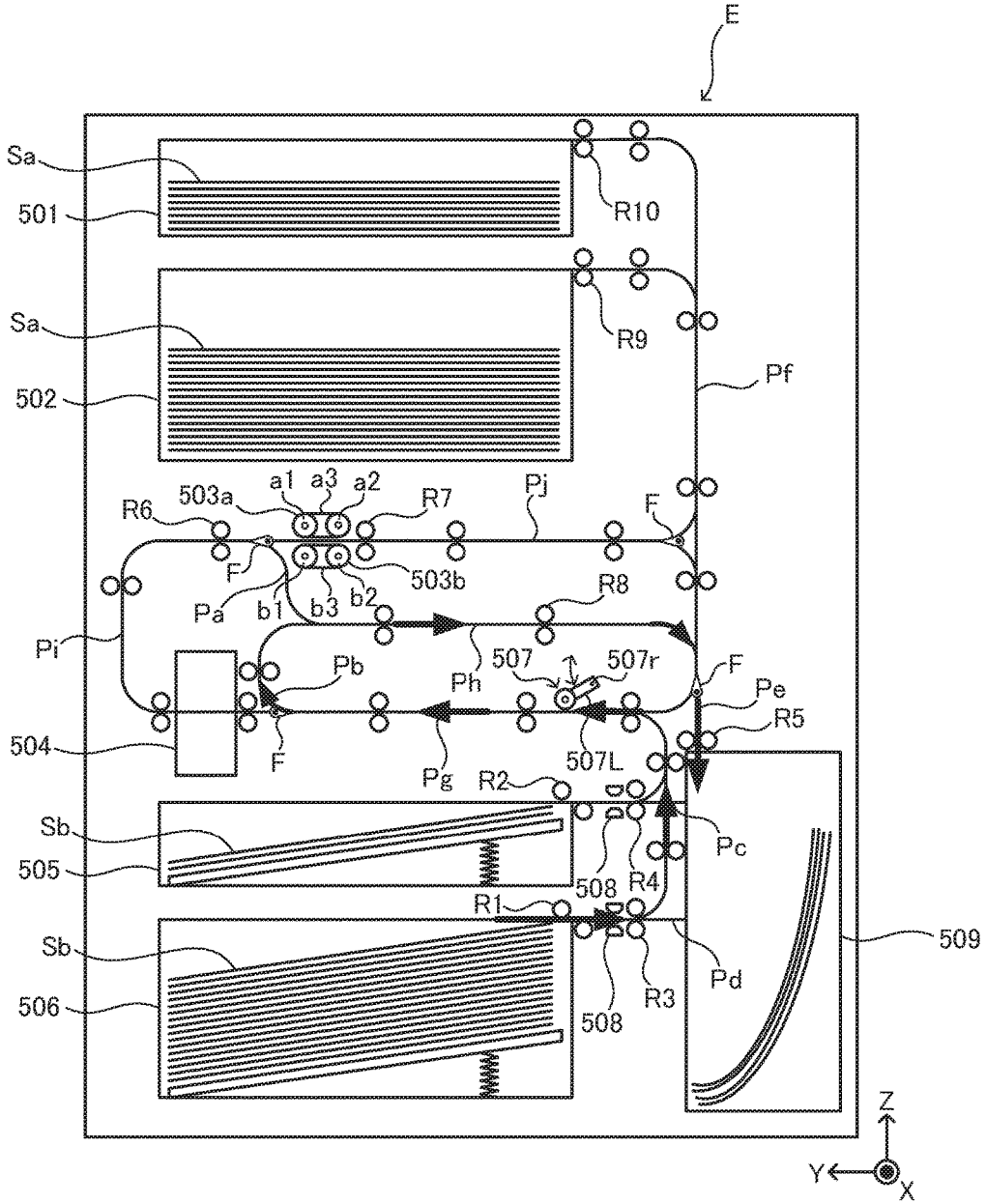
FIG. 5 is a diagram illustrating how a sheet is transferred in the image decoloring device E.

If the thickness of the sheet obtained by the thickness sensor 507 exceeds a predetermined threshold (Yes of Act 105), the PROCESSOR 801 ejects the sheet to the reject box 509 through the transfer paths Pb, Ph and Pe (Act 114) (see arrowed thick lines in FIG. 5).

The transfer path Pb is arranged upstream of a direction in which a sheet is transferred with respect to the line sensor 504. This prevents entry of a sheet into the line sensor 504 that has a thickness exceeding an allowable level of a thickness set for the line sensor 504. Accordingly, problems such as a jam of a sheet in the line sensor 504 or breakdown of the line sensor 504 can be prevented.

If the sheet is fed solely without combination with another sheet (No of Act 103) and if the thickness of the sheet does not exceed the predetermined threshold (No of Act 105), the PROCESSOR 801 causes the line sensor 504 to read an image from either side of the sheet (Act 106).

Figure 6:
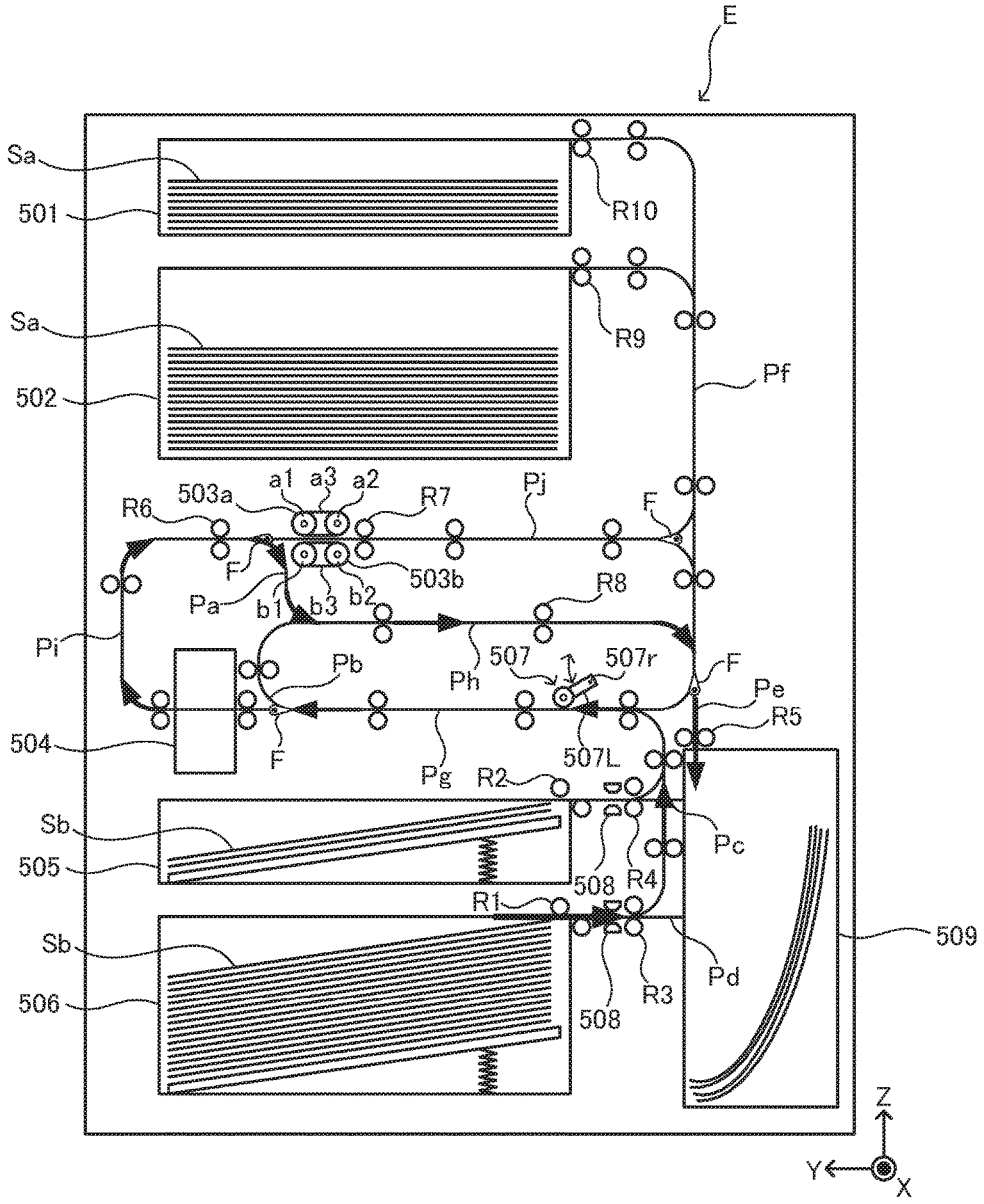
FIG. 6 is a diagram illustrating how a sheet is transferred in the image decoloring device E.
Figure 7:
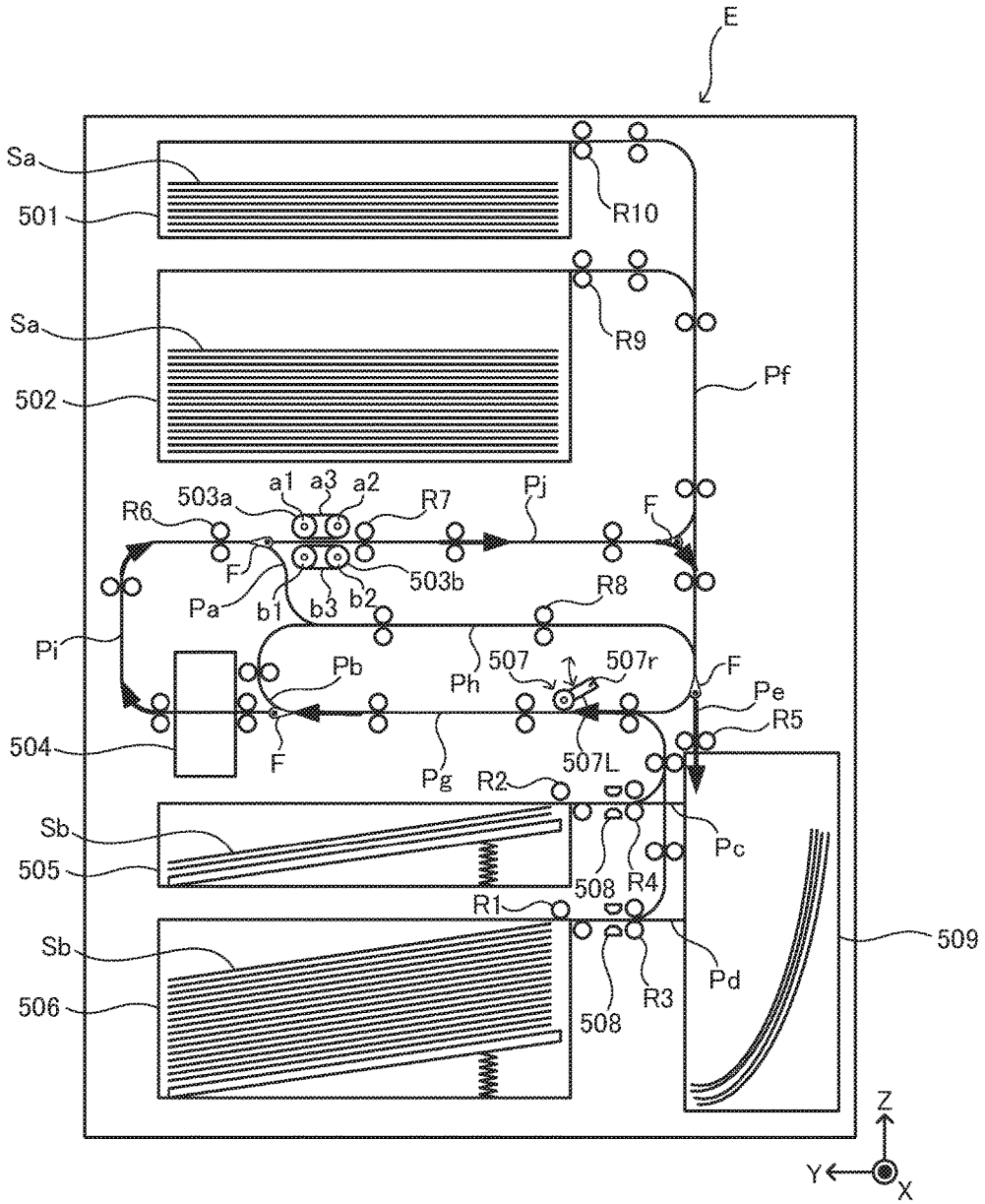
FIG. 7 is a diagram illustrating how a sheet is transferred in the image decoloring device E.
Figure 8:
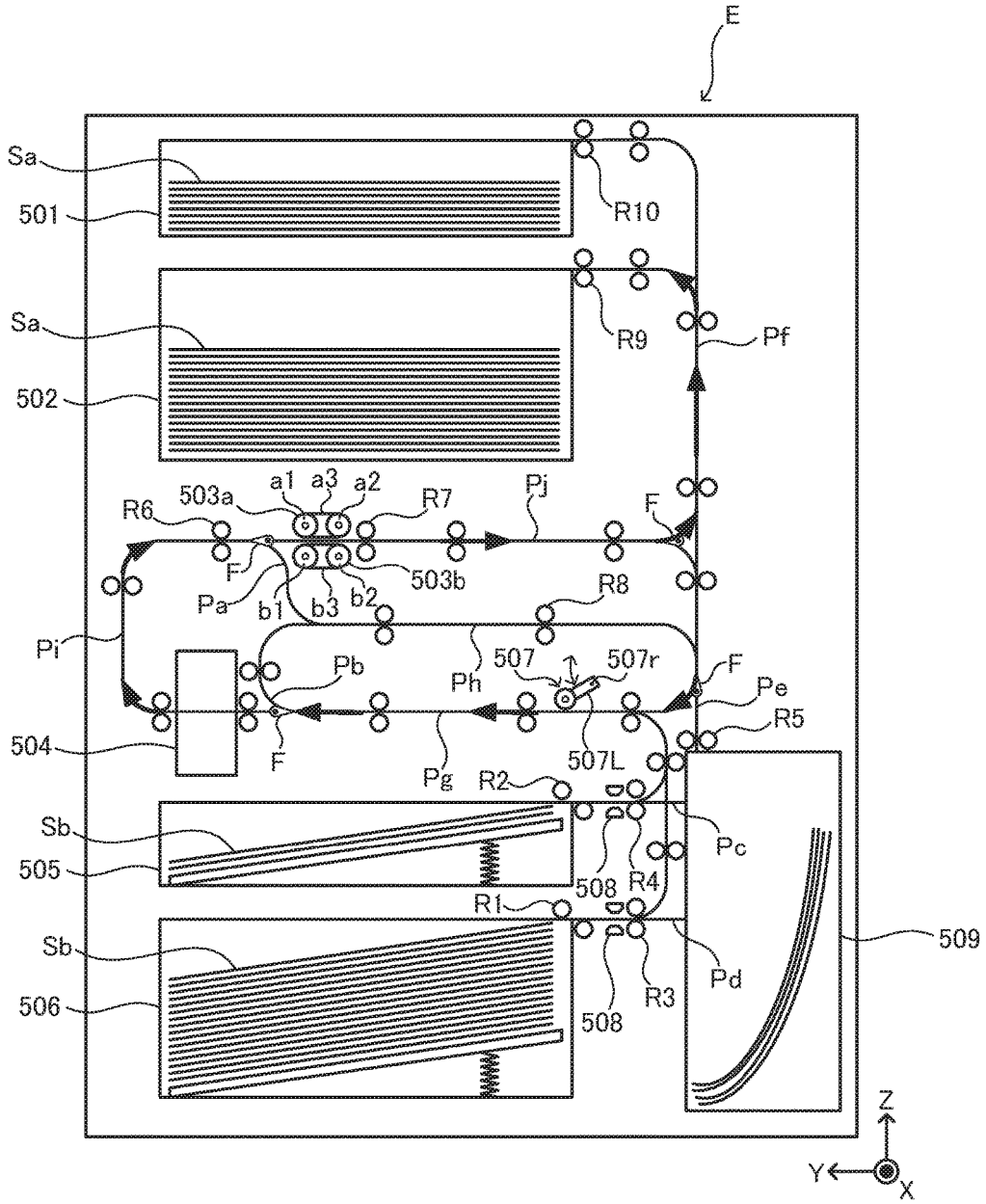
FIG. 8 is a diagram illustrating how a sheet is transferred in the image decoloring device E.

If the "print percentage" or "print density" of the sheet obtained by the line sensor 504 based on the read image exceeds a predetermined threshold (Yes of Act 107), the PROCESSOR 801 controls the transfer rollers R6, R7, R5 and others to eject the sheet through the transfer paths Pi, Pj and Pe to the reject box 509 (Act 114) (see arrowed thick lines in FIG. 6).

Based on the information obtained from the line sensor 504, the thickness sensor 507 and others, the PROCESSOR 801 (process controlling unit) manages control parameters for the decoloring realized by the cooperation of the decoloring processing units 503*a*, 503*b* and the sheet carrying unit (Act 108). The PROCESSOR 801 manages control parameters in the following exemplary ways (1) to (10):

(1) The temperature of heat applied in the decoloring by the decoloring processing units 503*a* and 503*b* is increased with a higher "print percentage" obtained by the line sensor 504 (print condition detection unit).

(2) The temperature of heat applied in the decoloring by the decoloring processing units 503*a* and 503*b* is increased with a higher "print density" obtained by the line sensor 504 (print condition detection unit).

(3) The temperature of heat applied in the decoloring by the decoloring processing units 503*a* and 503*b* is controlled based on the "color" of an image obtained by the line sensor 504 (print condition detection unit).

(4) The temperature of heat applied in the decoloring by the decoloring processing units 503*a* and 503*b* is increased if the line sensor 504 (print condition detection unit) determines that an image is formed on either side of a sheet.

(5) The temperature of heat applied in the decoloring by the decoloring processing units 503*a* and 503*b* is increased with a greater "thickness of a sheet" obtained by the thickness sensor 507.

(6) A speed at which a sheet is caused to pass through the decoloring processing units 503*a* and 503*b* by the transfer rollers R6, R7 and the decoloring processing units 503*a*, 503*b* (sheet carrying unit) is reduced with a higher "print percentage" obtained by the line sensor 504 (print condition detection unit).

(7) A speed at which a sheet is caused to pass through the decoloring processing units 503*a* and 503*b* by the transfer rollers R6, R7 and the decoloring processing units 503*a*, 503*b* (sheet carrying unit) is reduced with a higher "print density" obtained by the line sensor 504 (print condition detection unit).

(8) A speed at which a sheet is caused to pass through the decoloring processing units 503*a* and 503*b* by the transfer rollers R6, R7 and the decoloring processing units 503*a*, 503*b* (sheet carrying unit) is reduced with a lower brightness level of the "color" of an image obtained by the line sensor 504 (print condition detection unit).

(9) If the line sensor 504 (print condition detection unit) determines that an image is formed on either side of a sheet, a speed at which a sheet is caused to pass through the decoloring processing units 503*a* and 503*b* by the transfer rollers R6, R7 and the decoloring processing units 503*a*, 503*b* (sheet carrying unit) is set lower than that applied in the case where an image is formed on only one side of a sheet targeted for the decoloring.

(10) A speed at which a sheet is caused to pass through the decoloring processing units 503*a* and 503*b* by the transfer rollers R6, R7 and the decoloring processing units 503*a*, 503*b* (sheet carrying unit) is reduced with a greater "thickness of a sheet" obtained by the thickness sensor 507.

As a matter of course, some of the foregoing ways (1) to (10) may suitably be combined to manage control parameters.

Based on a control parameter set in the foregoing ways for the sheet targeted for the decoloring, the PROCESSOR 801 causes the transfer rollers R6, R7 and the decoloring processing units 503*a*, 503*b* to become cooperative to perform the decoloring on this sheet (Act 109).

The PROCESSOR 801 transfers the sheet after being subjected to the decoloring through the transfer paths Pj and Pg to the line sensor 504. Then, the line sensor 504 reads an image from either side of the sheet after being subjected to the decoloring (Act 110).

If it is determined as a result of the image reading that the color of a colorant the density of which is no less than a predetermined level remains unremoved on the sheet (Yes of Act 111), the PROCESSOR 801 determines the number of times the decoloring was performed on the sheet (Act 112). If the number of times the decoloring was repeated is the same as or greater than a fixed number (Yes of Act 112), the PROCESSOR 801 determines that the color is hardly removed from the sheet. Accordingly, the PROCESSOR 801 causes the sheet carrying unit to eject the sheet to the reject box 509 through the transfer paths Pi, Pj and Pe (Act 114) (see arrowed thick lines in FIG. 7). History information indicating the number of times the decoloring was performed on a sheet may be stored, for example, in the MEMORY 803 or the HDD 804.

If the number of times the decoloring was not repeated is the same as or greater than the fixed number (No of Act 112), the PROCESSOR 801 performs the decoloring again.

The PROCESSOR 801 causes the line sensor 504 to read an image from either side of the sheet after being subjected to the decoloring. Then, if it is determined that the color of a colorant the density of which is no less than the predetermined level is removed from the sheet (No of Act 111), the PROCESSOR 801 causes the sheet carrying unit to eject the sheet to the ejecting cassette 501 or 502 through the transfer paths Pi, Pj and Pf (Act 113) (see arrowed thick lines in FIG. 8).

Second Embodiment

A second embodiment is described next.

The second embodiment is a modification of the first embodiment. Parts having the same functions as those of the first embodiment are designated by the same reference numerals, and the descriptions thereof are not given repeatedly.

Figure 9:
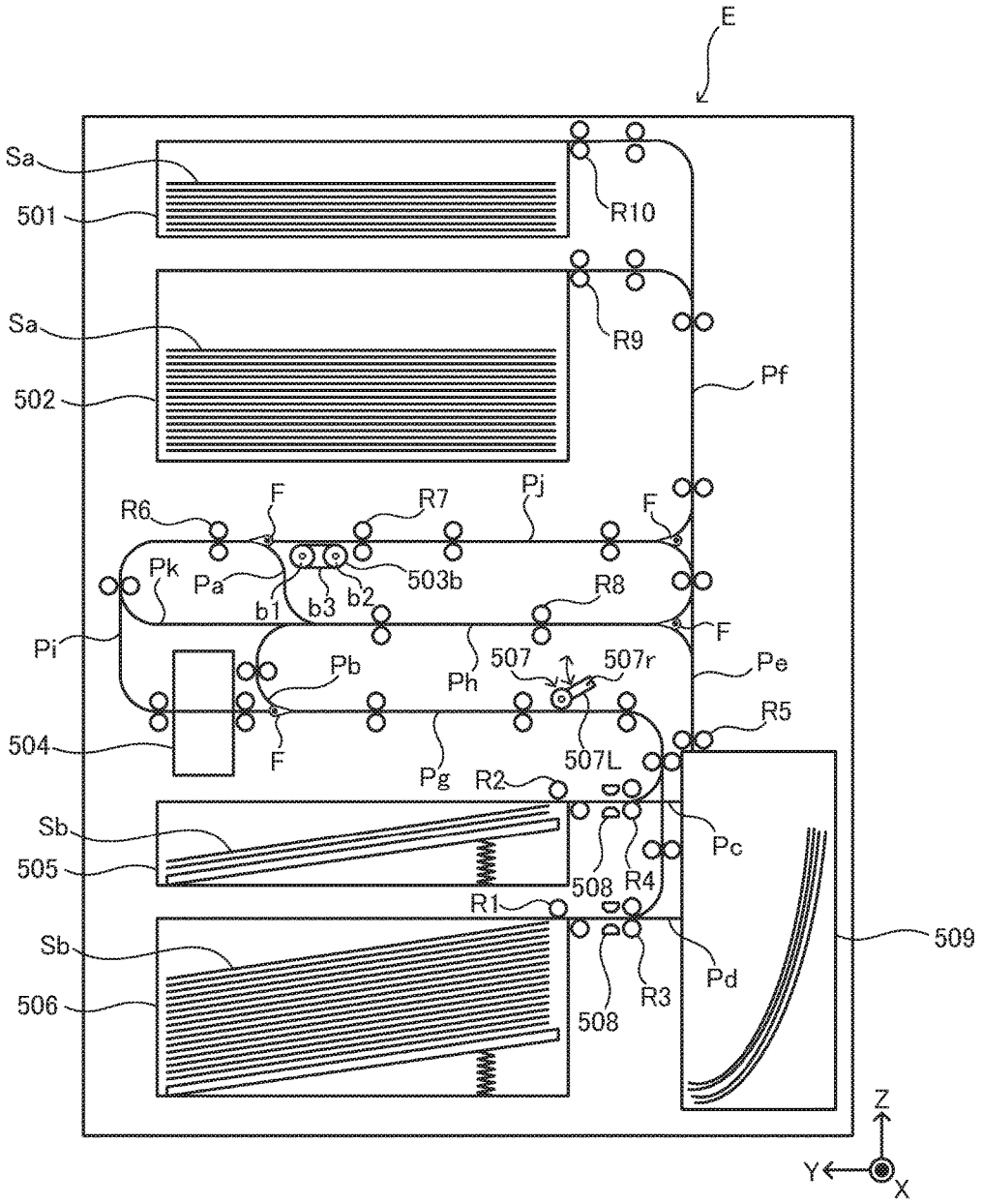
FIG. 9 is a vertical cross-sectional view illustrating the internal structure of an image decoloring device E of a second embodiment.

FIG. 9 shows a vertical cross-sectional view of the internal structure of an image decoloring device E' of the second embodiment.

Unlike that of the first embodiment, the image decoloring device E' of the second embodiment does not include the decoloring processing unit 503*a*. The image decoloring device E' of the second embodiment includes another transfer path Pk.

Figure 10:
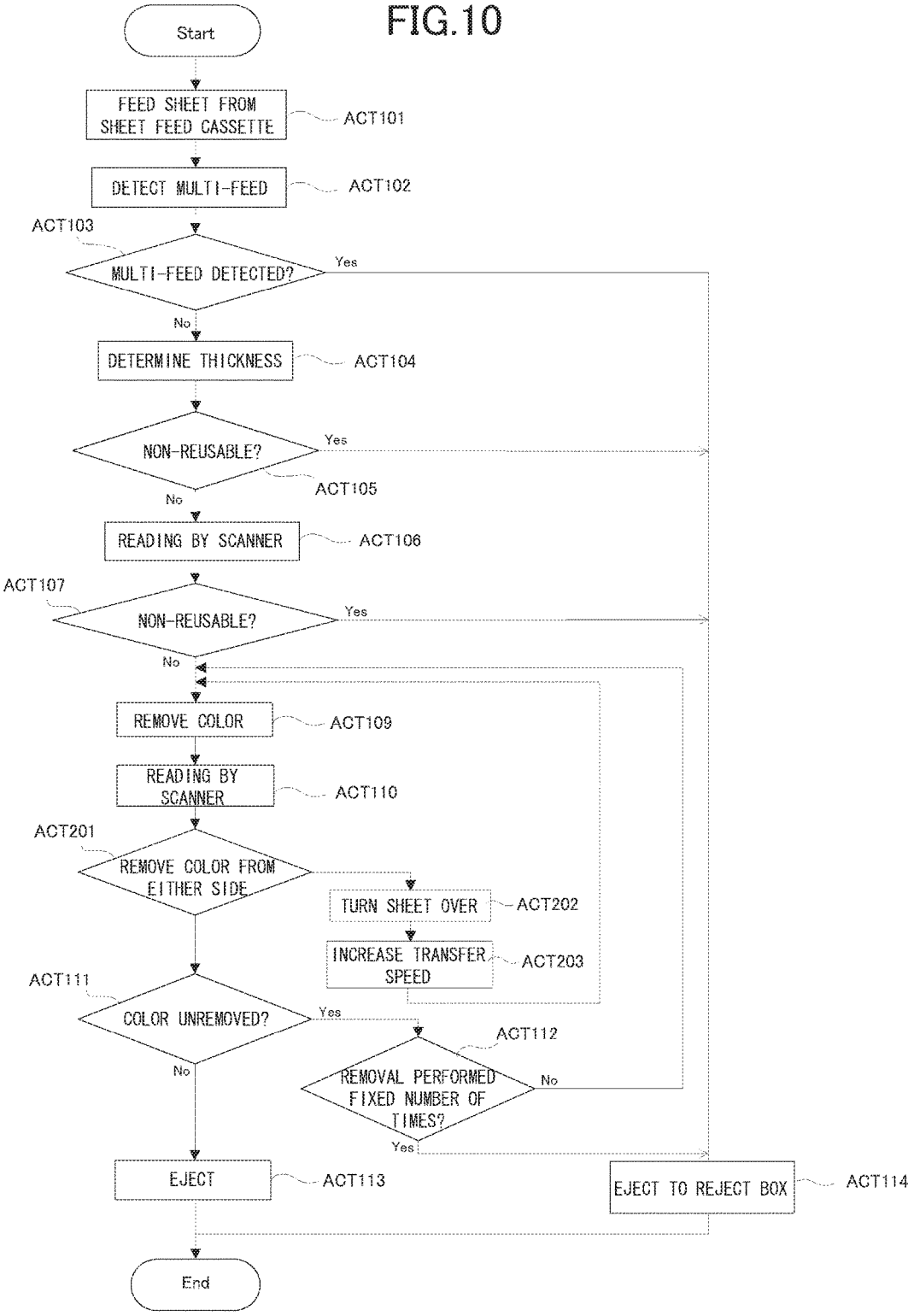
FIG. 10 is a flow chart explaining the flow of a process in the image decoloring device E' of the second embodiment.

FIG. 10 is a flow chart explaining the flow of a process in the image decoloring device E'.

Acts 101 to 107 and Acts 109 to 114 of this flow chart are the same as those of the corresponding Acts of that shown in FIG. 3, and are not described again.

If it is determined as a result of image reading by the line sensor 504 (Act 110) that an image is formed on either side of a sheet (Yes of Act 201), the PROCESSOR 801 (process controlling unit) causes the sheet to switchback to turn the sheet over (Act 202). Next, the PROCESSOR 801 sets a second speed V2 of transfer by the sheet carrying unit in second decoloring to be higher than a first speed V1 of transfer by the sheet carrying unit in first decoloring (Act 203), and then realizes the second decoloring (Act 109).

Specifically, the PROCESSOR 801 (process controlling unit) causes the sheet to pass through (1) the line sensor 504, (2) the transfer path Pi, (3) the decoloring processing unit 503*b*, (4) the transfer path Pi, (5) the transfer path Ph, (6) the transfer path Pk, (7) the transfer path Pa, (8) the transfer path Ph, (9) the transfer path Pk, and (10) the decoloring processing unit 503*b* in this order, thereby performing the decoloring on this sheet on either side thereof.

If it is determined as a result of image reading by the line sensor 504 (Act 110) that an image is formed on either side of a sheet (Yes of Act 201), the PROCESSOR 801 (process controlling unit) causes the sheet to pass through the decoloring processing unit 503*b* twice by the sheet carrying unit. So, the decoloring processing unit 503*b* performs decoloring twice. The PROCESSOR 801 also sets a second temperature T2 of heat applied in the second decoloring by the decoloring processing unit 503*b* to be lower than a first temperature T1 of heat applied in the first decoloring by the decoloring processing unit 503*b*. (As an example, the second and first temperatures T2 and T1 of heat are set to 140 degrees C. and 180 degrees C., respectively.)

If it is determined as a result of image reading by the line sensor 504 (Act 106) that the print density of any side of a sheet is below a predetermined lower limit, the PROCESSOR 801 (process controlling unit) causes the decoloring processing unit 503*b* to perform decoloring once.

Likewise, if the thickness of a sheet obtained by the thickness sensor 507 exceeds a predetermined threshold, the PROCESSOR 801 (process controlling unit) causes the sheet to pass through the decoloring processing unit 503*b* twice by the sheet carrying unit. So, the decoloring processing unit performs decoloring twice. The PROCESSOR 801 may also set the second temperature T2 of heat applied in the second decoloring by the decoloring processing unit 503*b* to be lower than the first temperature T1 of heat applied in the first decoloring by the decoloring processing unit 503*b*.

If the thickness of a sheet obtained by the thickness sensor 507 is below a predetermined lower limit, the PROCESSOR 801 (process controlling unit) causes the decoloring processing unit 503*b* to perform decoloring once on this sheet.

Third Embodiment

A third embodiment is described next.

The third embodiment is a modification of the embodiments described above. Parts having the same functions as those of the aforementioned embodiments are designated by the same reference numerals, and the descriptions thereof are not given repeatedly.

In an image decoloring device E" of the third embodiment, the PROCESSOR 801 functions as a power consumption mode detection unit and a process controlling unit.

The PROCESSOR 801 (power consumption mode detection unit) determines which one of the following modes is selected: a "power-saving mode" in which power consumed in decoloring by the decoloring processing units 503*a* and 503*b* is set not to exceed a predetermined level; and a "normal mode" in which the decoloring processing units 503*a* and 503*b* perform the decoloring while consuming power greater than that set in the power-saving mode. Setting of a power consumption mode in the image decoloring device E" is stored as setting information in the MEMORY 804 or HDD 805, for example. The PROCESSOR 801 obtains the setting information to determine the setting of the power consumption mode.

The power consumption mode in the image decoloring device E" may be set, for example, by making input through the operational input unit 805.

If the PROCESSOR 801 (power consumption mode detection unit) determines that the "power-saving mode" is selected, compared to the case where the "normal mode" is selected, the PROCESSOR 801 (process controlling unit) reduces a speed at which a sheet is caused to pass through the decoloring processing units 503*a* and 503*b* by the sheet carrying unit, while decreasing the temperature of heat applied from the decoloring processing units 503*a* and 503*b* to a sheet.

In each of the exemplary embodiments shown above, the decoloring processing unit removes a color by applying heat. However, a control parameter applied in the decoloring is not limited to that of application of heat. As an example, a sheet on which an image is formed with a decolorable colorant may dip in a chemical solution. Or, a chemical solution may be sprayed onto the sheet, or the sheet may be exposed in a gas atmosphere. In either case, the concentration of the chemical solution or the gas, the temperature of the chemical solution or the gas, a combination ratio of specific components, a time of exposure to the chemical solution or the gas and the like are naturally used as parameters instead of the temperature of heat applied from the decoloring processing unit.

Each of the aforementioned operations of the process in the image decoloring device is realized by the execution of a decoloring control program stored in the memory 803 by the PROCESSOR 801.

A program for causing a computer constituting the image decoloring device to execute each of the aforementioned operations may be provided as a decoloring control program. In the exemplary embodiments, the program for realizing the functions to implement the invention is stored in advance in a storage region in the device. However, a similar program may be downloaded from a network to the device. Or, a similar program stored in a computer-readable recording medium may be installed on the device. The recording medium may be of any type, as long as the recording medium is a computer-readable recording medium in which a program can be stored. Specific examples of the recording medium include an internal storage device provided in a computer such as a ROM and a RAM, a portable recording medium such as a CD-ROM, a flexible disk, a DVD disk, a magneto-optical disk and an IC card, a database in which a computer program is stored, another computer and its database, and an online transmission medium. The function obtained by the previous installation or download may be realized in cooperation with an OS (operating system) and the like running in the device.

Part of or all of the program may be an executable module created dynamically.

In the aforementioned embodiments, as a matter of course, each of the processes is realized by causing a processor to execute a program. As a matter of course, at least some of the processes may be realized in a circuit by the ASIC 802.

As is understood from the detailed description given above, the technique disclosed herein is capable of providing a technique that contributes to power-saving in removal of a color from an image formed on a sheet with what is called a removal colorant.

While certain embodiments have been described, these embodiments have been presented by way of example only, and are not intended to limit the scope of invention. Indeed, the novel apparatus and methods described herein may be embodied in a variety of other forms; furthermore, various omissions, substitutions and changes in the form of the apparatus and methods described herein may be made without departing from the spirit of the inventions. The accompanying claims and their equivalents are intended to cover such forms or modifications as would fall within the scope and spirit of the inventions.

What is claimed is:

1. An image decoloring device comprising:

a decoloring processing unit configured to remove a color of a decolorable colorant that forms an image on a sheet by applying heat to the sheet;

a sheet carrying unit configured to convey the sheet through the decoloring processing unit; and a processor configured to:

determine a selection of a decoloring mode of the decoloring processing unit as one of a normal mode and a power-saving mode, and control the decoloring processing unit and the sheet conveying unit to perform decoloring processing in accordance with the selected decoloring mode, wherein when the selected decoloring mode is the normal mode, the processor performs the decoloring processing by controlling the decoloring processing unit to apply heat at a first temperature to the sheet and controlling the sheet carrying unit to convey the sheet through the decoloring processing unit at a first speed, and when the selected decoloring mode is the power-saving mode, the processor performs the decoloring processing by controlling the decoloring processing unit to apply heat at a second temperature lower than the first temperature to the sheet and controlling the sheet carrying unit to convey the sheet through the decoloring processing unit at a second speed slower than the first speed.

2. The device according to claim 1, further comprising:

an operational unit configured to receive an input for setting the decoloring mode of the image decoloring device as one of the power-saving mode and the normal mode.

3. The device according to claim 2, wherein the processor determines the decoloring mode of the image decoloring device to be one of the power-saving mode and the normal mode based on the received input.

4. The device according to claim 1, wherein the decoloring processing unit comprises a heatable roller.

5. A method of controlling an image decoloring device which performs decoloring processing in a power-saving mode and in a normal mode, the method comprising the steps of:

determining a decoloring mode for the decoloring processing as one of the power-saving mode and the normal mode;

conveying a sheet through a decoloring processing unit, wherein when the determined decoloring mode is the normal mode, the sheet is conveyed at a first speed, and when the determined decoloring mode is the power-saving mode, the sheet is conveyed at a second speed slower than the first speed; and decoloring, with the decoloring processing unit, a color of a decolorable colorant that forms an image on the sheet by applying heat to the sheet, wherein when the determined decoloring mode is the normal mode, the decoloring processing unit applies the heat at a first temperature to the sheet, and when the determined decoloring mode is the power-saving mode, the decoloring processing unit applies the heat at a second temperature lower than the first temperature to the sheet.

6. The method of claim 5, further comprising the step of:

receiving an input for setting the decoloring mode of the image decoloring device as one of the power-saving mode and the normal mode.

7. The method of claim 6, wherein the decoloring mode of the image decoloring device is determined to be one of the power-saving mode and the normal mode based on the received input.

8. The method according to claim 5, wherein the decoloring processing unit comprises a heatable roller.

* * * * *